US006094835A

United States Patent [19]

Cromer

[11] Patent Number: 6,094,835

[45] Date of Patent: Aug. 1, 2000

[54] HEAT PUMP DRYER WITH DESCICCANT ENHANCED MOISTURE REMOVAL

[75] Inventor: Charles J. Cromer, Cocoa Beach, Fla.

[73] Assignee: University of Central Florida, Orlando, Fla.

[21] Appl. No.: 09/211,398

[22] Filed: Dec. 14, 1998

[51] Int. Cl.[7] ..... F26B 21/06

[52] U.S. Cl. ..... 34/80; 34/77; 34/86; 62/94; 62/271

[58] Field of Search ..... 34/80, 81, 86, 34/299, 300, 515, 72–76, 77, 108, 82, 132; 62/94, 271

[56] References Cited

U.S. PATENT DOCUMENTS

| | | | |
|---|---|---|---|
| 3,242,589 | 3/1966 | Jacobs | 34/133 |
| 3,766,660 | 10/1973 | Settlemeyer | 34/9 |
| 4,057,907 | 11/1977 | Rapino et al. | 34/4 |
| 4,125,946 | 11/1978 | Prager | 34/80 |
| 4,251,924 | 2/1981 | Beck et al. | 34/22 |
| 4,281,465 | 8/1981 | Zimmerman | 34/26 |
| 4,644,666 | 2/1987 | Eberle | 34/515 |
| 4,719,761 | 1/1988 | Cromer | 62/94 |
| 5,092,135 | 3/1992 | Cameron | 62/271 |
| 5,343,632 | 9/1994 | Dinh | 34/507 |
| 5,546,678 | 8/1996 | Dhaemers | 34/275 |
| 5,666,739 | 9/1997 | Krueger | 34/86 |
| 5,752,323 | 5/1998 | Hashimoto | 34/80 |

FOREIGN PATENT DOCUMENTS

| | | | |
|---|---|---|---|
| 3044331 | 6/1982 | Germany | 34/515 |

OTHER PUBLICATIONS

"MAM Series: Combination Dehumidifier and Air Conditioning (Split Systems)", *Dectron,* Advertisement (no date listed).

"CRD Series: Wall–Hung Packaged 100% Outdoor Air Dehumidifier", *Dectron,* Advertisement (no date listed.

"Calorex Heat Pumps: Your Heat Pump Partner for Dehumidification, Drying and Heat Recovery", *Calorex,* Advertisement (no date listed).

"Controllable Dew Point Dryer Assures Precision Dryness and Part Flexibility", *Novatec,* General Product Brochure (no date listed).

"Kathabar Liquid Desiccant Dehumidifcation Systems", *Kathabar Systems,* Advertisement (no date listed).

*Primary Examiner*—James C. Yeung

*Attorney, Agent, or Firm*—Brian S. Steinberger; Law Offices of Brian S. Steinberger

[57] ABSTRACT

A method and apparatus for enhancing the evaporation and moisture removal from moisture laden products in a dryer. The invention combines the inventor's prior U.S. Pat. No. 4,719,761, with a rotating drying drum having filters at the output area, and a separate pump for allowing condensation from a chilled coil to drain off, while a desiccant formed from pads or a rotatable wheel is part of a continuous feedback loop for recycling moisture. A condenser is positioned between the desiccant and the drying drum and is used as a heat exchanger for both the air inlet to the drum and the air outlet from the drum. Additionally, the evaporator drain pipe can form an additional heat exchanger when the pipe is used in the pathway of air passing from the desiccant to the evaporator coil. The invention is useful for drying various items such as clothes, agricultural products, wood, vegetables, fruit and electric components such as wafers.

15 Claims, 6 Drawing Sheets

HEAT PUMP DRYER WITH DESCICCANT ENHANCED MOISTURE REMOVAL

This invention relates to a method and apparatus for the dehumidification of dryer air to a reduced moisture content for the purpose of drying a product or material which is exposed to the dryer air and is dried thereby through the evaporation of moisture from the product or material into the dryer air and is an improvement over U.S. Pat. No. 4,719,761 filed May 30, 1986 and issued on Jan. 19, 1988, by the same inventor thereof, which is incorporated by reference.

BACKGROUND AND PRIOR ART

U.S. Pat. No. 4,719,761 to Cromer, the same inventor as the subject invention, encompassed a cooling system. The Cromer '761 patent was a method and apparatus for increasing removal of moisture in a cooling system which provided for a desiccant to contact and evaporate moisture into dry feed air prior to passing the feed air over cooling coils in order to increase the dew point (moisture content) of the feed air. This increases the moisture removal of the cooling system. The desiccant material is loaded with moisture by absorption of moisture from the moisture saturated air leaving the cooling coils. The method included removing the moisture by a desiccant from the saturated air leaving a cooling means and delivering it to air entering the cooling means which significantly increases the dehumidification of the air passing through the cooling means. The cycling of moisture from the saturated air leaving the cooling coils and evaporating this same moisture into the air entering the cooling coils for the enhanced dehumidification of the coils has become known as the "Cromer Cycle" and is the subject of prior U.S. Pat. No. 4,179,761 by the subject inventor thereof, which is incorporated by reference.

Attempts have been proposed to use desiccants. See for example, U.S. Pat. No. 3,766,660 to Settlemyer and U.S. Pat. No. 4,125,946 to Prager. However, these patents use an external heat source to dry the desiccant which is energy inefficient. U.S. Pat. No. 5,092,135 to Cameron uses a vacuum to dry the desiccant, a very energy inefficient process. The U.S. Pat. No. 4,057,907 to Rapino, et al. uses the combination of several drying methods: a vacuum, microwaves, ultrasonics and cosolvents, on the material to be dried to increase the drying rate, but these methods are also very inefficient in the BTU moisture removed per BTU energy expended. Materials are typically dried by passing heated air over the material. In these systems, they start by converting only 50% of the energy input into moisture removal. At the end of the drying process, typically only 10% of the energy input is converted into moisture removal. There heated-air systems average no better than 30% of the input energy into removal of moisture. Attempts have been made to improve efficiencies by recouping some of the heat by heat exchangers or heat pipes as in the U.S. Pat. No. 5,343,632 to Dinh.

The vapor compression cooling system moves heat more efficiently than it can be created by burning fuel. It may be applied to a closed loop dryer system as in U.S. Pat. No. 3,922,798 to McMillan. However, only slight improvements in efficiencies are obtained over heated air systems because the cooling coil typically removes only 20–25% of its work in moisture, the remaining 80% goes to cool the air which must be reheated by the condenser. U.S. Pat. No. 5,343,632 to Dinh attempts to reduce the amount of reheat needed by recouping some of the heat by heat exchanger or heat pipes.

The use of a desiccant to transfer moisture from the air leaving the cooling coil to the air entering the cooling coil not only increases the dryer temperature and reduces the dryer air humidity which increases the air capacity to remove moisture from the product, it also improves the moisture removal of the cooling coil as much as 70% of the work going to moisture removal and only 30% going to cool the air. This provides substantial energy efficiency improvement over previous drying methods in the conversion of energy input to moisture removal.

SUMMARY OF THE INVENTION

The first objective of the present invention is to provide a desiccant to increase a dryer's air temperature to enhance products being dried.

The second object of this invention is to provide a desiccant to lower a dryer's humidity and increase the dryer's capacity to extract moisture from wet products being dried.

The third object of this invention is to provide a desiccant to both increase a dryer's air temperature and to lower a dryer's humidity and increase the dryer's capacity to extract moisture from wet products being dried.

The fourth object of this invention is to provide a method of drying which is more efficient in the conversion of energy input to moisture removal than any previous method.

The improvements in the subject invention over the prior U.S. Pat. No. 4,719,761 to Cromer, involve the addition of condenser heat to the air leaving the desiccant prior to entering the drying chamber, or the addition of condenser heat to the air leaving the dryer chamber and prior to entering the desiccant, or the addition of condenser heat at both locations in the system.

Adding condenser heat to the process air leaving the desiccant prior to entering the drying chamber improves the drying capacity of the dryer air by increasing its temperature which lowers its relative humidity thus increasing its capacity to extract moisture from the material or product to be dried. This improves the overall drying efficiency of the Cromer Cycle described in U.S. Pat. No. 4,719,761. Adding condenser heat to the return air leaving the dryer chamber increases its temperature and capacity to extract moisture from the desiccant, thus improving the moisture transfer of the Cromer Cycle and further enhancing the dehumidification of the cooling coil and the overall drying efficiency of the Cromer Cycle. It should be clear that the addition of condenser heat to both the process air and return air may be balanced in such a way as to optimize the moisture removal of the Cromer Cycle and thus the drying rate and capacity for a required drying temperature and thus produce a very energy efficient dryer system.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
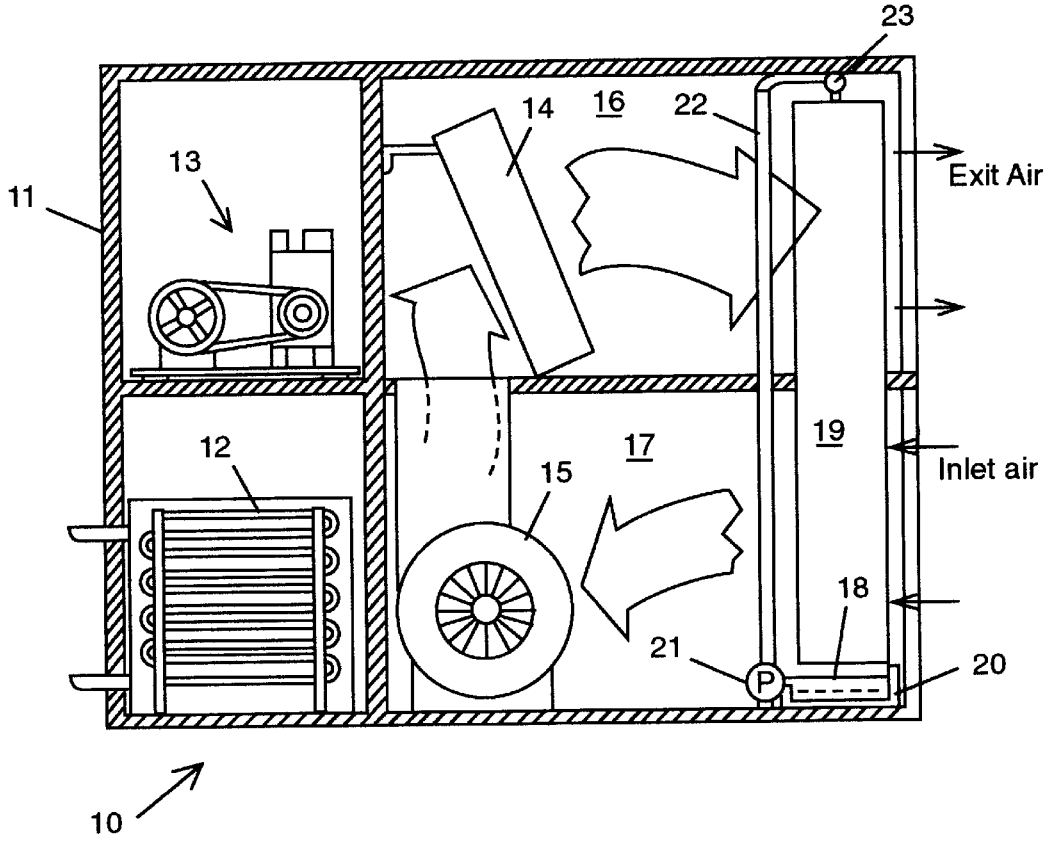
Fig. 1 (Prior Art)
FIG. 1 is a side sectional view of the Prior Art Cromer Cycle in accordance with U.S. Pat. No. 4,719,761.

Referring to FIG. 1, an air conditioning and moisture removal system 10 in accordance with U.S. Pat. No. 4,719,761, is illustrated placed in a housing 11 and having the standard air r conditioning components of a condenser 12 which may be a water source or an air to air type condenser. The system also has a compressor 13 which compresses a refrigerant used in the system. The refrigerant is liquified in the condenser 12 and has the heat removed through a heat exchanger forming part of the condenser and then expands into a cooling coil 14. The cooling coil acts as a heat exchanger and is positioned for air to pass through as shown by the arrows through a blower or fan 15 through the cooling coil 14 and out an exit passage 16. An inlet passage 17 brings in the return air drawn by the blower 15 passes through the cooling coil and heat exchanger 14 and out exit passage 16. In the prior system of FIG. 1, a plurality of vertical extending evaporator pads 19 extend across the inlet passageway 17 and the exit passageway 16. A liquid desiccant 18 collects in a trough 20 where a pump 21 pumps the liquid through a line 22 through nozzles 23 where it is sprayed upon the pads 19. The liquid desiccant allows the pads 19 to capture additional moisture leaving the exit passageway 16 to let the moisture drain down the pads 19 across the inlet passage 17 where the return air is entering the system and where the moisture is then evaporated back into the return air and partially removed by the cooling coils 14 and further removed by the liquid desiccant passing down the pads 19 in the exit air.

Figure 2A:
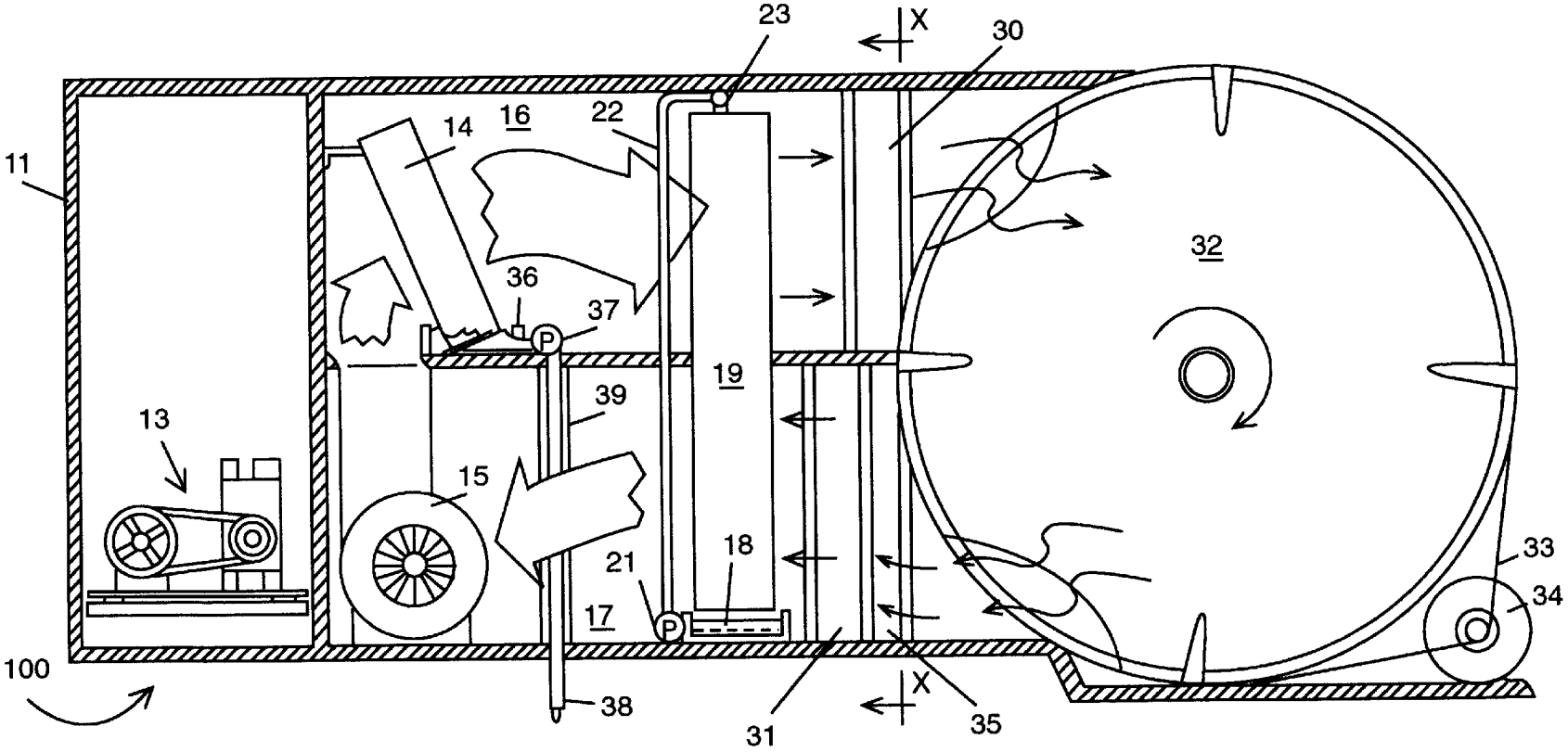
FIG. 2A is a side sectional view of a first embodiment of a Cromer Cycle Dryer using desiccant pads.

Referring to FIG. 2A, the improved moisture removal of the system 100 has the condenser 12 of the prior system is split to two parts 30 and 31. The exit air from exit passage 16 and having moisture absorbed therefrom by the desiccant pads 19 passes through condenser 30 prior to entering the drying chamber 32. The condenser 30 being a heat exchanger of the refrigerant to air type, imparts a portion of the heat of condensation of the refrigerant compressed by compressor 13, to the exit air. This additional heat in the exit air over the existing exit air temperature provides an improvement in the moisture removal capacity of the exit air or dryer air before it enters drying chamber 32. The dryer air enters drying chamber 32 which is a rotating drum driven by belt 33 and an electric motor 34 where it removes moisture from the material or product to be dried. This removal of moisture from the product cools the dryer air and loads it with moisture from the product. This air then returns to the Cromer Cycle Dryer and enters through an air filter 35. The return air then passes through a return air condenser heat exchanger 31 which in a fashion similar to the exit air condenser heat exchanger 30, adds heat to the air. This heat is added to the return air prior to the air entering the desiccant pad 19 and the inlet passage 17. This additional heat in the return provides an improvement in the moisture removal capacity of the return air before it enters the desiccant pad 19. This improved moisture removal capacity of the return air provides for an improved moisture transfer from the desiccant pad 19 to the return air which adds more moisture to the air of inlet passage 17 which improves the moisture removal of the cooling coil 14. FIG. 4 is a separate view of the valving system used with the heat exchangers and cooling coils of FIGS. 2A, 2B, 3A and 3B.

Referring to FIG. 4, the cooling coil 14 is shown with a thermostatic expansion valve 313 and temperature sensor 314 common in the art. The amount of heat added by the condenser heat exchanger 30 and 31 can be adjusted by a valve 311 on the refrigerant line 315 and the heat added by the condenser heat exchanger 31 can be adjusted by a valve 310 on line 315 to optimize the moisture removal of the dryer system and further, when drying temperature sensitive product or material. Some heat may still be expunged from the system by the condenser 12 of my prior U.S. Pat. No. 4,719,761, through a valve 312 on refrigerant line 315.

Referring to FIG. 2A, the condensate condensed on the cooling coil is collected in a trough 36 and exits the system by the drain tube 38 either pumped by pump 37 or by gravity flow. The drain tube 38 may be formed to comprise a heat exchanger 39 to pre-cool the return air of the inlet passage 17 before it enters the cooling coil 14. This absorbs some heat from the return air thus improving the moisture removal of the cooling coil.

Figure 2B:
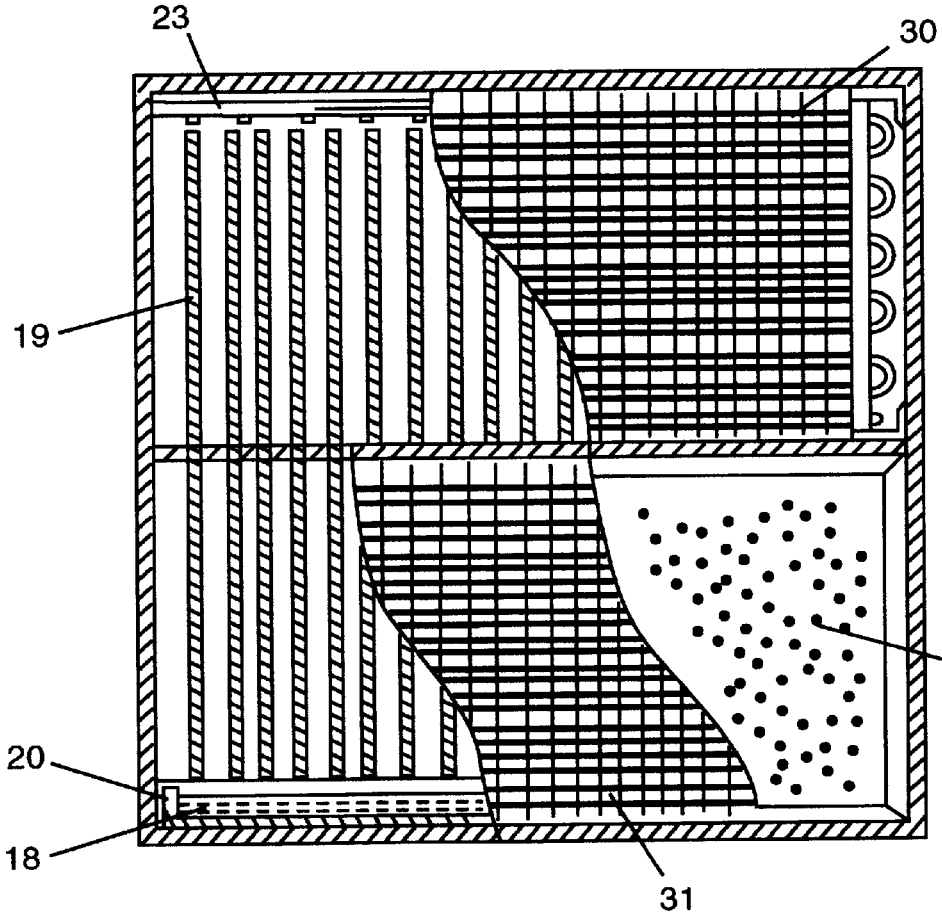
FIG. 2B is an end view of the first embodiment of FIG. 2A along arrow X.

FIG. 2B is an end view of the fist embodiment of FIG. 2A along arrows X.

Figure 3A:
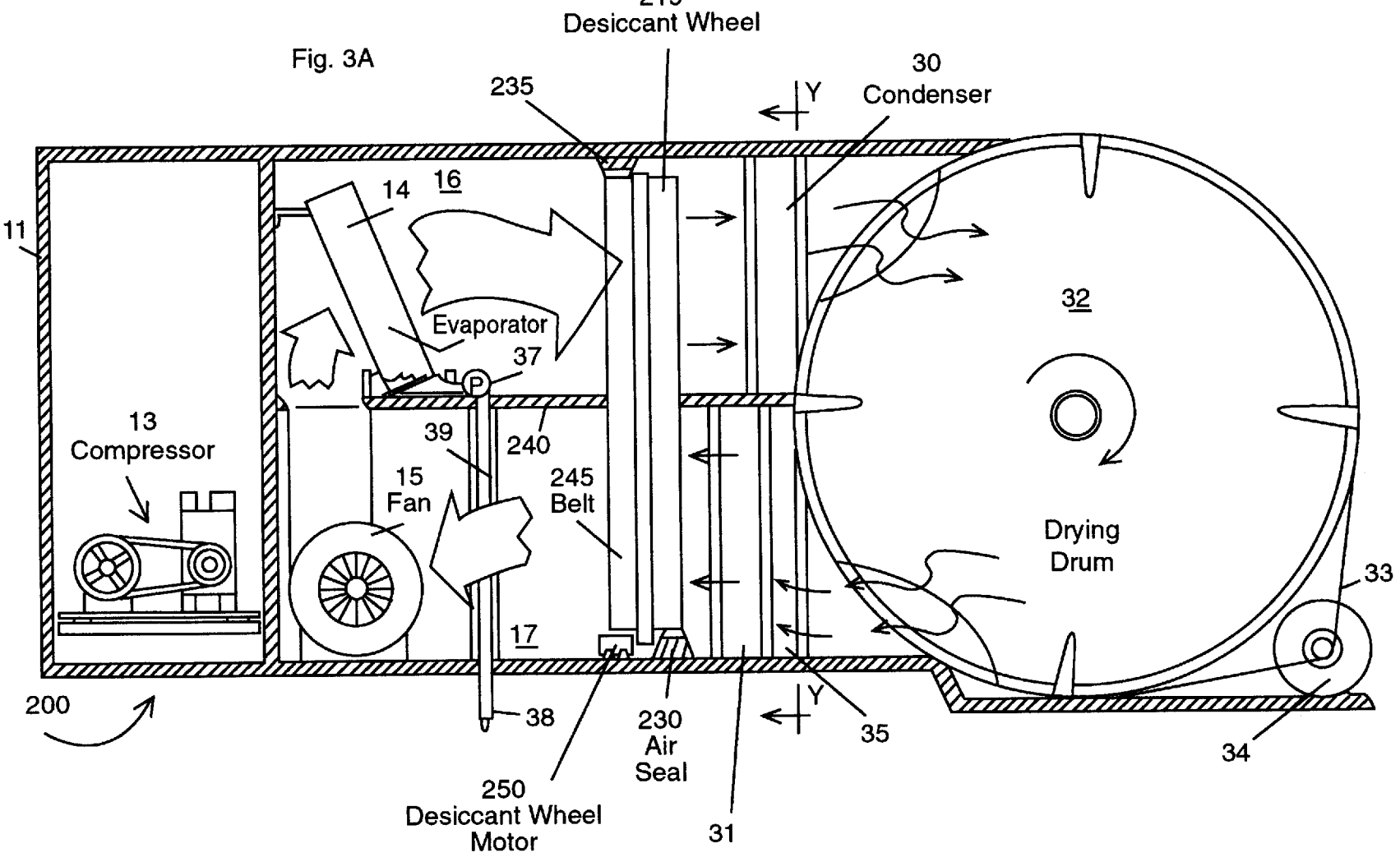
FIG. 3A is a side sectional view of a second embodiment of a Cromer Cycle Dryer using a rotatable desiccant.
Figure 3B:
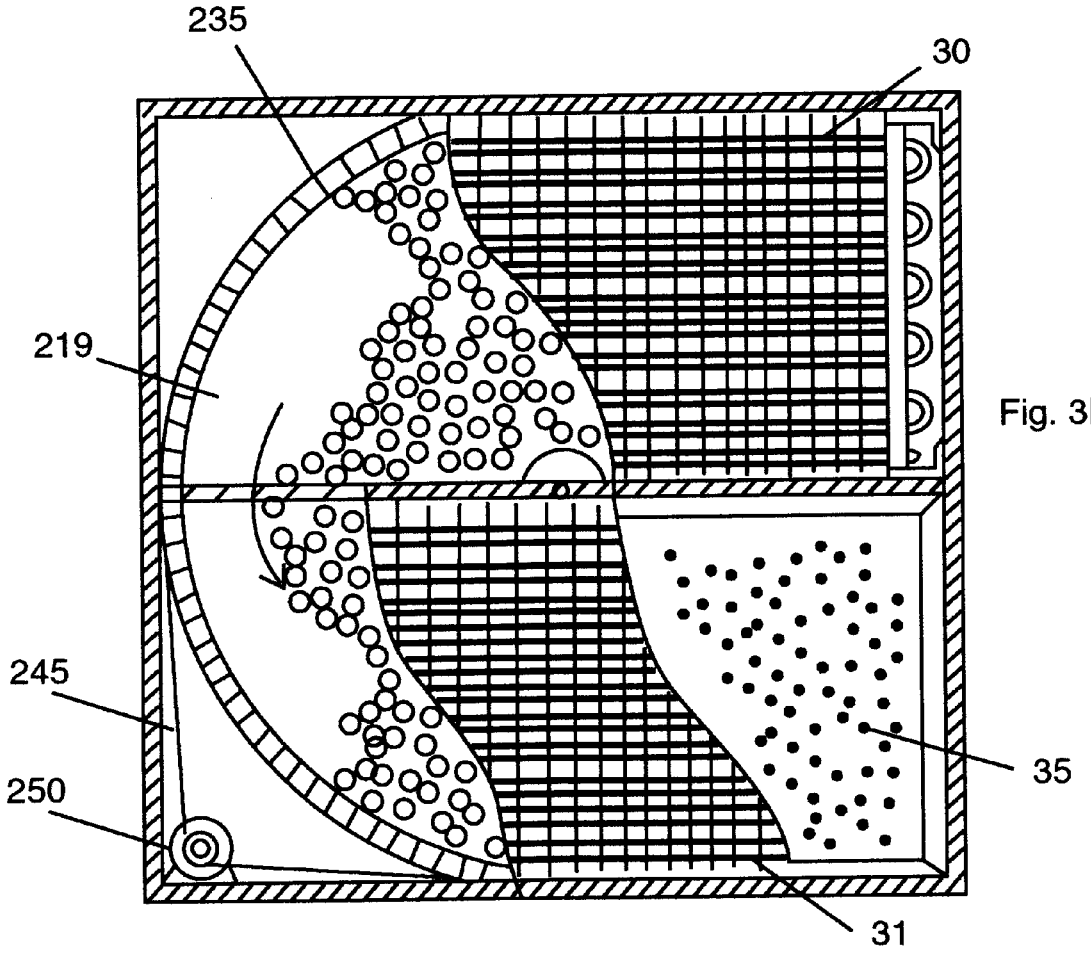
FIG. 3B is an end view of the second embodiment of FIG. 3A along arrow Y.
Figure 4:
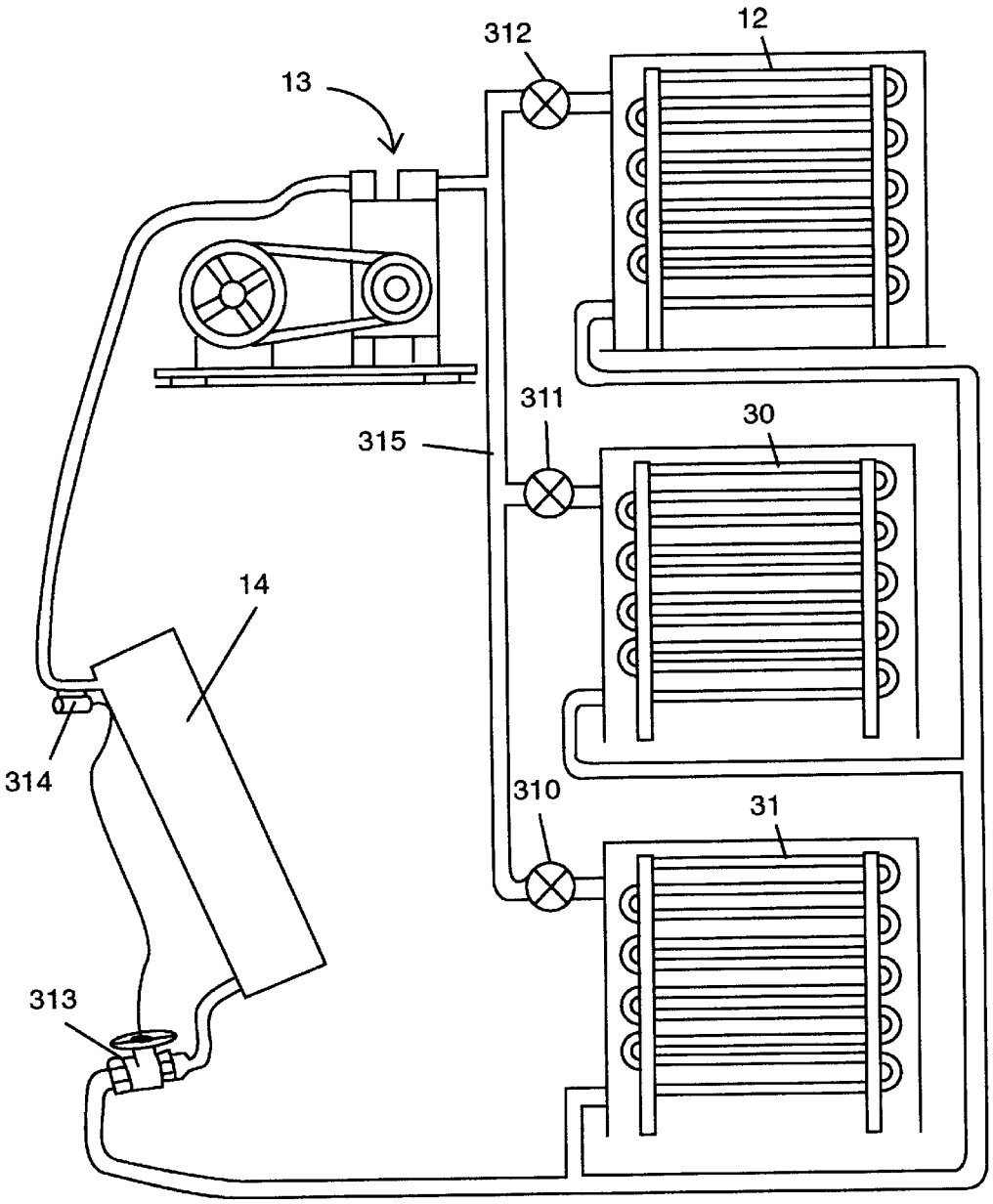
FIG. 4 is a separate view of the valving system used with the heat exchangers and cooling coils of FIGS. 2A, 2B, 3A and 3B.

FIG. 3A is a side sectional view of a second embodiment of a Cromer Cycle Dryer using a rotatable desiccant. FIG. 3A substitutes a desiccant wheel 219 having an exterior belt 245 which is rotated by a wheel motor 250 allowing desiccant wheel 219 to rotate about axle 240. Air seal rings 230, 235 about the exterior of wheel 219 provide a seal between wheel 219 and housing 11. FIG. 3B is an end view of the second embodiment of FIG. 3A along arrows Y.

The invention can be used for drying various products such as but not limited to clothes, agricultural products, wood, vegetables, fruit, electric components such as wafers, and the like.

It should be clear that the present invention is a method and apparatus for removing moisture from air used to produce dryer air which enhances the moisture removal system set forth in U.S. Pat. No. 4,719,761. However, this moisture removal system should not be considered as limited to the forms shown which are to be considered illustrative rather than restrictive.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A method of removing moisture from moisture laden products in a dryer chamber using a desiccant attached to an air cooling system, comprising the steps of:

(a) removing moisture from products by passing air through a dryer chamber;

(b) heating return air exiting from the dryer chamber with a heat exchanger;

(c) adding moisture from the heated return air with a desiccant means to form feed air;

(d) condensing moisture from the feed air with a cooling means of an air cooling system to form near saturated, cooled feed air;

(e) removing moisture from the near saturated, cooled feed air with the desiccant means to form inlet air; and (f) heating the inlet air to the dryer chamber with the heat exchanger, and repeating steps (a) through (f) whereby increased moisture removal is obtained by the combining the air cooling system with a desiccant.

2. The method of removing moisture from moisture laden products in a dryer chamber of claim 1, further comprising the step of:

filtering the return air exiting from the dryer chamber.

3. The method of removing moisture from moisture laden products in a dryer chamber of claim 1, further comprising the step of:

cooling feed air prior to step (d) with an additional heat exchanger means.

4. An improved moisture removal system for dryers, comprising:

a dryer chamber having air passing therethrough for removing moisture laden products within the chamber to an outlet;

a desiccant for adding moisture to the outlet air of the dryer chamber to an incoming air line;

a cooling means on an air cooling system for condensing moisture from the incoming air line, wherein the dryer chamber receives moisture reduced air from the cooling means, and wherein the desiccant further includes a portion for removing moisture from the cooling means; and a heat exchanger means for heating air between the desiccant and the dryer chamber.

5. The improved moisture removal system for dryers of claim 4, further comprising:

a filter between the desiccant and the dryer chamber, for filtering air exiting the dryer chamber.

6. The improved moisture removal system for dryers of claim 4, wherein the cooling means further includes:

a cooling heat exchanger for pre-cooling the air before the air reaches the cooling means.

7. The improved moisture removal system for dryers of claim 4, wherein the desiccant includes:

a rotatable desiccant wheel.

8. The improved moisture removal system for dryers of claim 7, further includes:

a seal means for allowing the rotatable desiccant wheel to sealingly rotate within a housing.

9. The improved moisture removal system for dryers of claim 4, wherein the desiccant includes:

a desiccant pad.

10. The improved moisture removal system for dryers of claim 4, wherein the cooling means includes:

an evaporator on the air conditioning system.

11. The improved moisture removal system for dryers of claim 4, wherein the heat exchange means includes:

a condenser on the air cooling system.

12. The improved moisture removal system for dryers of claim 4, wherein the heat exchange means includes:

a condensor on the air conditioning system.

13. The improved moisture removal system for dryers of claim 4, wherein the heat exchange means includes:

a compressor on the air cooling system.

14. The improved moisture removal system for dryers of claim 4, further comprising:

a condensate drainage line composed of a cooling heat exchanger for precooling the air before the air reaches the cooling means.

15. An improved moisture removal system for dryers, comprising:

a dryer chamber having air passing therethrough for removing moisture laden products within the chamber to an outlet;

a desiccant for adding moisture to the outlet air of the dryer chamber to an incoming air line;

a cooling means on an air cooling system for condensing moisture from the incoming air line, the dryer chamber receiving moisture reduced air from the cooling means, and the desiccant includes a portion for removing moisture from the cooling means; and a cooling heat exchanger for pre-cooling the air before it reaches the cooling means.

* * * * *